US005979059A

United States Patent [19]

Leatherman et al.

[11] Patent Number: 5,979,059

[45] **Date of Patent: *Nov. 9, 1999**

[54] FOLDING TOOL WITH LOCKING MECHANISM

[75] Inventors: Timothy S. Leatherman, Portland; Benjamin C. Rivera, West Linn; Philip C. Gibson, Portland, all of Oreg.

[73] Assignee: Leatherman Tool Group, Inc., Portland, Oreg.

[ * ] Notice: Under 35 U.S.C. 154(b), the term of this patent shall be extended for 584 days.

[21] Appl. No.: 08/662,263

[22] Filed: Jun. 7, 1996

Related U.S. Application Data

[63] Continuation of application No. 08/182,414, Jan. 13, 1994, abandoned.

[51] Int. Cl.[6] ..... B26B 3/06

[52] U.S. Cl. ..... 30/161; 7/128

[58] Field of Search ..... 30/158–161; 7/128

[56] References Cited

U.S. PATENT DOCUMENTS

| | | | |
|---|---|---|---|
| 458,664 | 9/1891 | Scholz | 30/161 |
| 1,362,142 | 12/1920 | Rohrer | 30/161 |
| 1,362,143 | 12/1920 | Rohrer | 30/161 X |
| 3,568,315 | 3/1971 | Smith | 30/161 |
| 4,238,862 | 12/1980 | Leatherman | 7/128 |
| 4,302,877 | 12/1981 | Hart et al. | 30/161 |
| 4,703,560 | 11/1987 | Brooker | 30/161 X |
| 4,741,106 | 5/1988 | Yamagishi | 30/161 |
| 4,888,869 | 12/1989 | Leatherman | 7/128 |
| 5,060,379 | 10/1991 | Neely | 30/161 |
| 5,327,651 | 7/1994 | Favreau | 30/161 |

FOREIGN PATENT DOCUMENTS

| | | | |
|---|---|---|---|
| 8310567 | 2/1984 | France . | |
| 159369 | 12/1903 | Germany | 30/161 |
| 822507 | 11/1951 | Germany . | |

*Primary Examiner*—D. S. Meislin
*Attorney, Agent, or Firm*—Chernoff, Vilhauer, McClung & Stenzel, LLP

[57] ABSTRACT

A locking mechanism for holding a selected blade or tool kit of a multi-purpose folding tool in an extended position. A base portion of each blade is mounted on a pivot pin mounted in a tool handle. The base portion includes a cam and a notch, and a spring included in the handle biases a flange against the cam and urges the flange into the notch to hold the selected blade in an extended position. The notch has a sharp lip and the flange is attached to the spring by a bend formed in a way leaving effectively a zero radius of curvature inside the bend. As a result, the lip of the notch and the inside corner surface of the bend defining the flange do not interact as cam and follower to urge the flange out from the notch, and a shorter flange and shallower notch are effective to lock the blade in position. A channel which receives and holds blades in a folded configuration of the tool has inside corners between sidewalls and a base, each corner having effectively a zero radius of curvature.

9 Claims, 7 Drawing Sheets

FOLDING TOOL WITH LOCKING MECHANISM

This application is a continuation of application Ser. No. 08/182,414, filed Jan. 13, 1994, now abandoned.

BACKGROUND OF THE INVENTION

This invention relates to a foldable knife or tool and more particularly to a mechanism for automatically locking a tool or knife blade into extended position with respect to a handle.

One of the inherent problems with folding, tools is the tendency of the tool blade to fold back toward the handle during use. Aside from interrupting the work, a collapsing blade can damage the workpiece or injure the user.

A wide variety of locking mechanisms have been devised to overcome this problem. At one end of the spectrum are the mechanisms which require additional manipulation to lock the tool blade into extended position, and further manipulations to unlock the tool blade so that it may be refolded. While these types of locking mechanisms can be very effective, the additional steps required to lock and unlock the blade may be considered undesirable. Mechanisms of this type are disclosed in Leatherman U.S. Pat. No. 4,888,869, and German Patent No. 822,507.

At the other end of the spectrum are automatic locking mechanisms which require no additional manipulation beyond extending and refolding the blade. The major disadvantage of these types of locking mechanisms is that they may not be reliable to lock the blade in extended position. An example of such an automatic locking mechanism is shown in Leatherman U.S. Pat. No. 4,238,862, disclosing a flat portion on the base of a blade interacting with a spring. This type of locking mechanism is sometimes called a "slip back" lock.

In the middle of the spectrum are locking mechanisms which lock automatically, but require additional manipulation to unlock. Examples of these types of mechanisms are shown in French Patent No. 83,10567; Hart et al. U.S. Pat. No. 4,302,877; Leatherman U.S. Pat. No. 4,238,862; and Neely U.S. Pat. No. 5,060,379.

While the locking mechanism disclosed, for example, in FIG. 6 of Leatherman U.S. Pat. No. 4,238,862 is functional, it is not completely satisfactory. One problem is that a lip defining one side of a notch receiving a spring-loaded catch can act as a cam and force the catch out of the notch, releasing the blade from a desired locked position.

In folding knives or multi-blade tools, the base of each blade or tool bit typically has a projection, sometimes called a "kick," which projects a small distance beyond the shank of a tool bit or a sharpened edge portion of a blade, to rest on structure within the handle or other part of the knife which holds the bits or blades when they are folded. The kick acts as a limit stop to hold the tools or blades in desired positions and prevent a sharpened edge from contacting any surfaces inside the handle when the blades are in their folded configuration. For a tool such as that shown in Leatherman U.S. Pat. No. 4,238,862, it has been necessary in the past to remove material so as to bevel an outside face of the kick of each blade or tool bit located adjacent a sidewall portion of a handle in the form of a U-shaped channel, to avoid undesired sideward forces on the blade and allow the kick to rest on the inside of the base of the U shape of the channel. Forming such a bevel is a time-consuming additional operation which adds to the cost of such folding-blade tools.

What is needed, then, is an improved locking mechanism which is engaged automatically upon placing a blade in a desired position and which is less susceptible than previously known locking mechanisms to being disengaged by the very forces it is intended to resist in a multi-blade tool which can be manufactured economically.

SUMMARY OF THE INVENTION

The present invention overcomes some of the aforementioned shortcomings of prior blade locking mechanisms and provides a folding knife or tool including an improved locking mechanism of the type which engages automatically but must be manipulated to release the locking mechanism and refold the knife blade or tool bit into the handle.

More particularly, the present invention provides a locking mechanism which is an improvement upon the mechanism shown in FIG. 6 of Leatherman U.S. Pat. No. 4,238,862. A catch includes a spring that is biased toward the base of a folding tool bit blade. The base of the blade has a radial notch defined therein and the catch includes a flange carried on the spring and received in the notch to lock any of several blades in respective extended positions and resist movement of the blades in either direction.

In one embodiment of the present invention, the end of the spring is bent to form the flange, and the surface of the inside corner of the resulting bend has effectively a "zero" radius. Such a zero effective radius of the inside corner may be obtained by removing or displacing material from the spring in the region of the bend, prior to or during the bending process. As a result, the surface of the inside corner is recessed or undercut so that it does not intrude into the space defined by the intersection of planes which are extensions of the inner surfaces of the spring and the flange of the catch.

Another aspect of the invention is that shaping the flange portion of the catch to a reduced thickness prior to or during bending facilitates providing a tight fit between the flange and the notch.

It is another aspect of one embodiment of the invention that the notch which receives the flange has a lip including a sharp corner which may be formed by grinding or cutting the base of the blade adjacent to the notch. The surfaces defining the sharp corner contact the flange adjacent the effectively zero radius inside corner between the flange and the spring. This acts to maximize the effectiveness of the surface contact of the flange with the inside wall of the notch and makes the catch reliable with a shorter flange portion. Preferably, both the lip of the notch and the surface of the inside corner between the spring and the flange therefore have effectively zero radii.

In another embodiment of the invention the flange is over-bent back toward the spring; that is, the angle between the flange and the spring is smaller than 90° and may be smaller than the angle at the sharp corner of the lip of the notch. The notch in the blade base may be shaped to include a bottom which is wider than the opening, or mouth of the notch, to further improve the security of this embodiment of the locking mechanism.

In another aspect of the invention, a tool with several folding blades and tool bits has a handle in the form of a U-shaped channel in which the bottom interior face of the channel extends substantially flat over the entire width defined between a pair of opposed interior surfaces of the side walls of the channel, so that there is effectively a zero radius in each elongate corner bend between the base and the sidewalls of the channel. As a result, it is unnecessary to a bevel the outer side of the kick of a blade located adjacent the sidewall to avoid sideward forces on the blade. According to a corresponding aspect of the method of manufacturing such a tool, a pair of parallel grooves are formed in the material which is to be bent to form the channel, so that the interior surfaces of the bends between the side walls and the base of the channel are recessed from the interior faces of the side walls.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
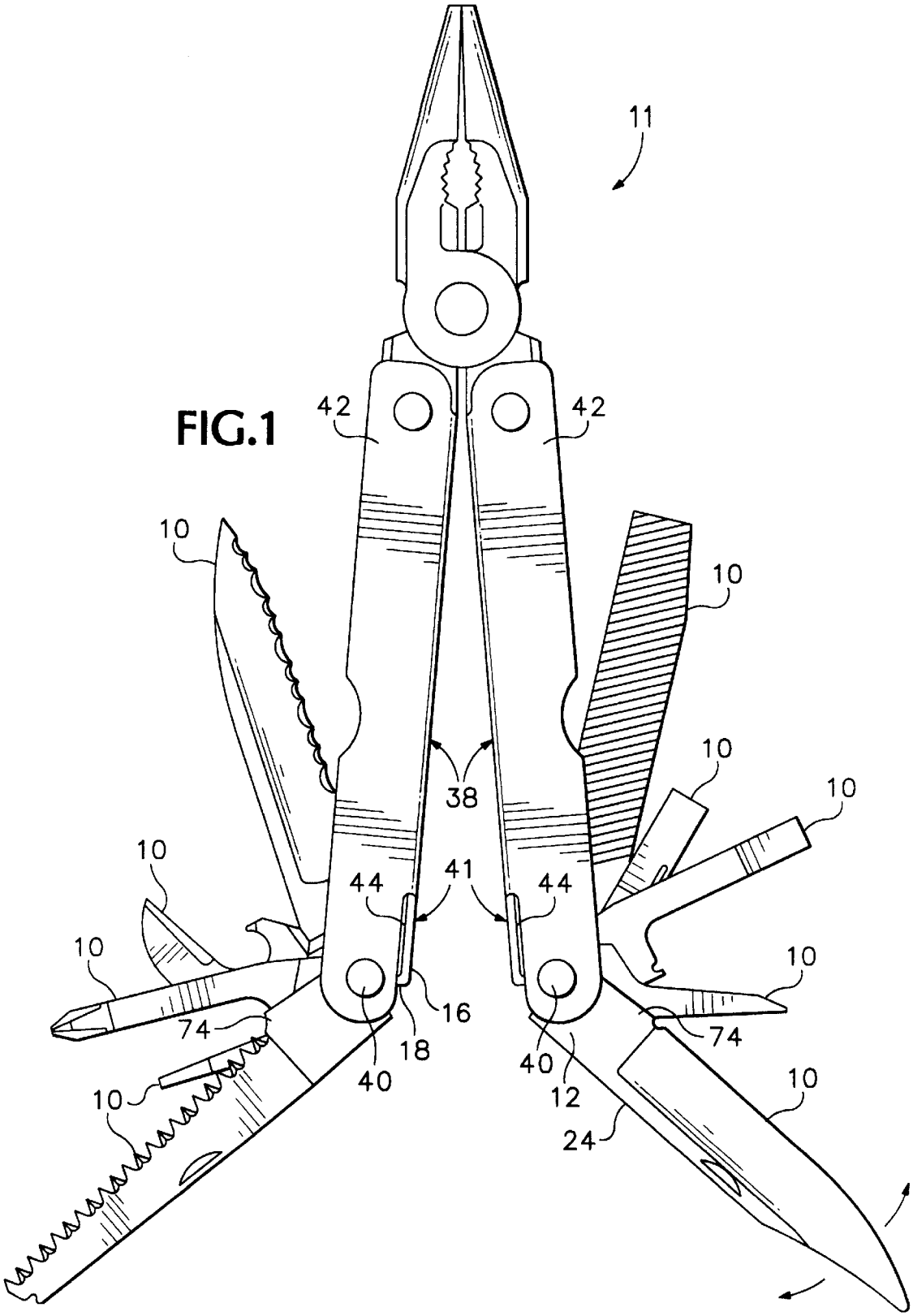
FIG. 1 is a side view of an exemplary multi-blade folding tool embodying the locking mechanism of the present invention, with the several blades in non-functional positions.
Figure 2:
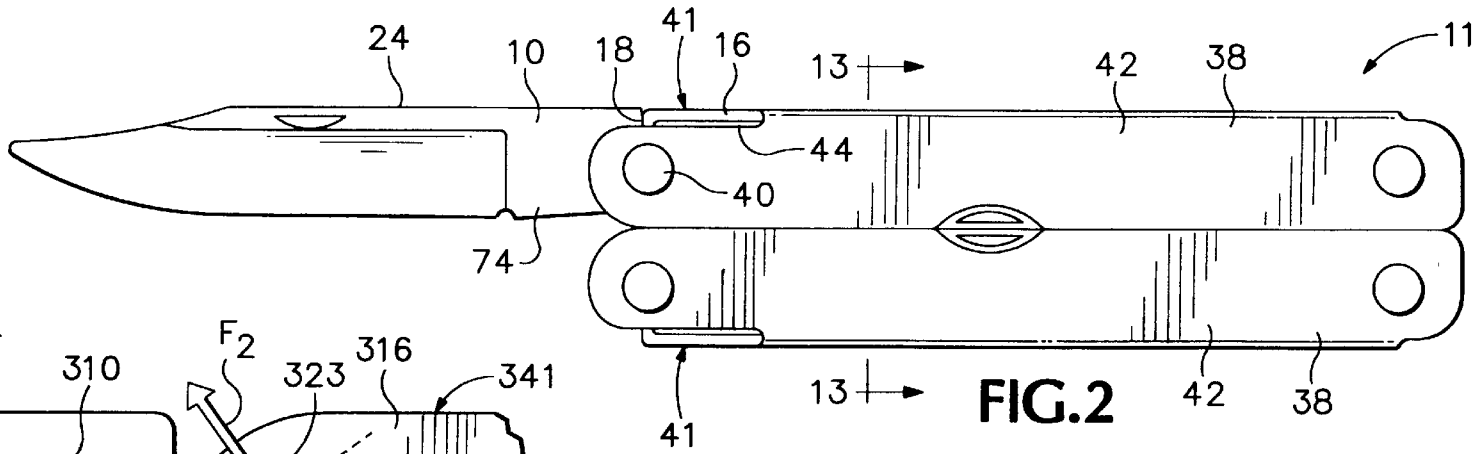
FIG. 2 is a side view of the tool shown in FIG. 1 with a blade locked in an extended position ready for use.

FIGS. 1 and 2 show an exemplary compact multipurpose folding tool 11 including the improved locking mechanism and handle configuration of the present invention. The tool 11 includes a pair of pivotally joined pliers jaws each having an associated handle member 38. Each unitary handle member 38 of the tool 11 houses several tool blades 10 which pivot independently of one another about a respective pin 40 at one end of each of the handle members. The handle members 38 are each constructed of sheet metal as a U-shaped channel, having a pair of parallel sidewalls 42 interconnected by the base 43 of the U, which serves as the back of the handle member 38. The pin 40 is mounted in and extends between the sidewalls 42 to attach the respective tool blades 10 to each handle member 38.

A pair of elongate parallel slits or cuts 44, which may be formed by lancing during a progressive die forming process, separate the sidewalls 42 from a portion of the back 43 of each handle member 38 near the pin 40, to define a spring catch 41 including a cantilevered flat spring 16. Each blade member 10 extends from a base 12 and all of the bases 12 have cam surfaces 46 which are substantially identical. The end of the spring 16 is bent downwardly, that is, toward the sidewalls 42, to form a substantially perpendicular flange 18 which bears against the curved cam surfaces 46.

Figure 3:
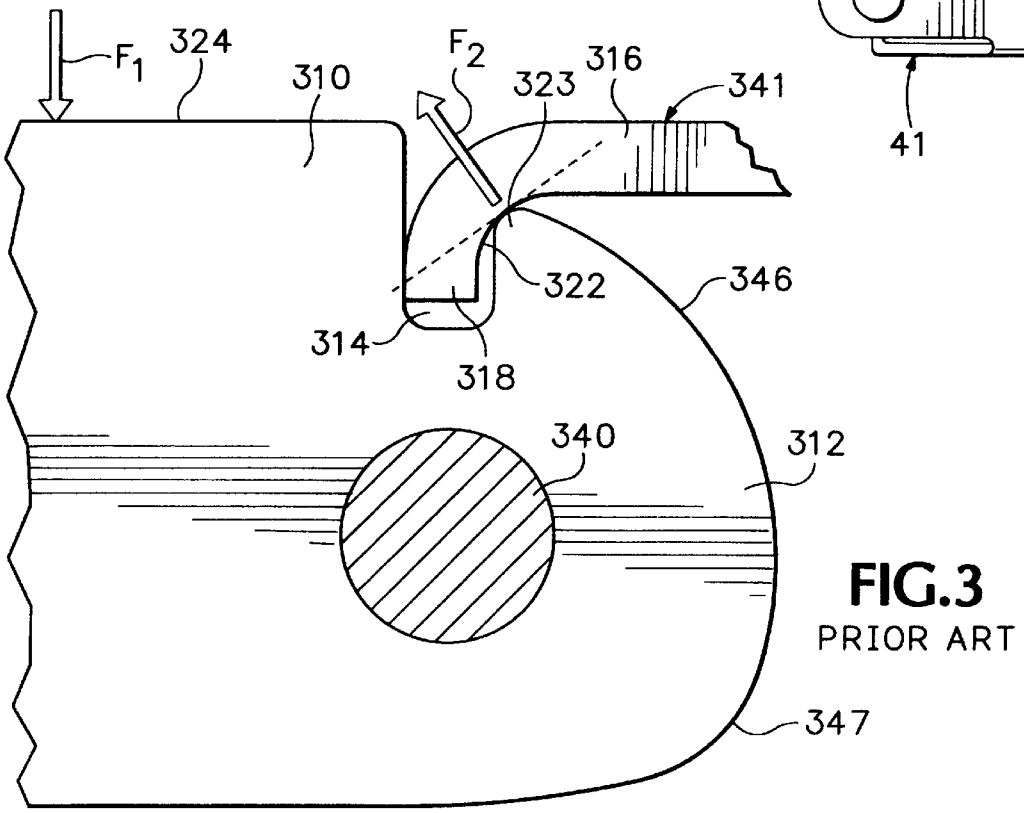
FIG.3 PRIOR ART
FIG. 3 is a side view of a detail of a folding tool including the prior art locking mechanism shown in Leatherman, U.S. Pat. No. 4,238,862.

A prior art locking mechanism for holding such blades 10 is shown in FIG. 3. It includes a tool blade 310 having a base 312 including a curved cam surface 346 and a radial notch 314. The end portion of a spring 316 of a catch 341 is bent downwardly, that is, toward the base 312, to form a flange 318 which is received in the radial notch 314 to lock the selected blade 310 in an extended position with respect to the tool handle (not shown), corresponding to the position of the blade 10 shown in FIG. 2. The blade 310 is released by partially opening another blade (not shown) located on the pivot pin 340 so that a cam lobe located on the base of the other blade, similar to the cam lobe 347 on the base 312, forces the flange 318 upwardly out of the notch 314, thereby unlocking the blade 310.

The expedient and economical way to create a catch 341 including the flange 318 on the end of the spring 316 is to bend the spring 316. Simply bending the material of the spring 316, however, creates a curved surface in the inside corner 322, as shown in FIG. 3. The curved surface of inside corner 322 has a radius of curvature which is typically a function of the thickness of the material and the interior angle of the bend. For example, a sheet of stainless steel sheet material having a nominal thickness of 0.050 inch (1.3 m), simply bent about a sharp edge to an interior angle of 90°, will typically have a radius of curvature of the inside corner 322 of approximately 0.050 inch (1.3 m), that is, about equal to the thickness of the material.

A force $F_1$ applied to the back 324 of the blade 310 and tending to rotate the blade 310 about pin 340 results in pressing the curved surface of the lip 323 of the notch 314 against the curved surface of the inside corner 322 of the catch 341, in the bend between the spring 316 and the flange 318, producing a force $F_2$ upon the catch. The force $F_2$ tends to push the flange 318 out of the notch 314.

It might appear that a tight fit of the flange 318 within the notch 314 would create a more secure locking mechanism. However, as may be seen in FIG. 3, the curved inside corner 22 would prevent the flange 318 from seating deeply if the notch 318 were narrow enough to receive the flange tightly, unless the flange 318 were made longer, which has disadvantages which will be explained presently.

Figure 4:
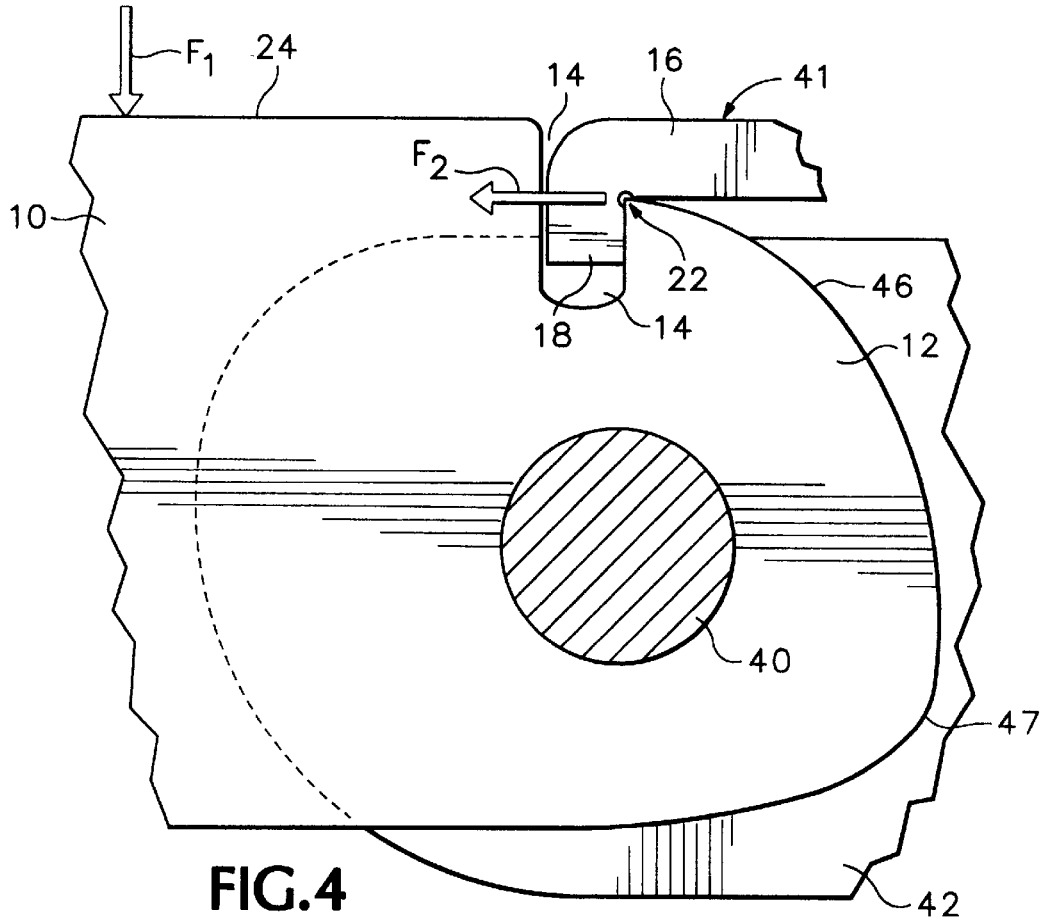
FIG. 4 is a side view of a detail of the tool shown in FIGS. 1 and 2 showing the improved locking mechanism of the present invention at an enlarged scale.
Figure 5:
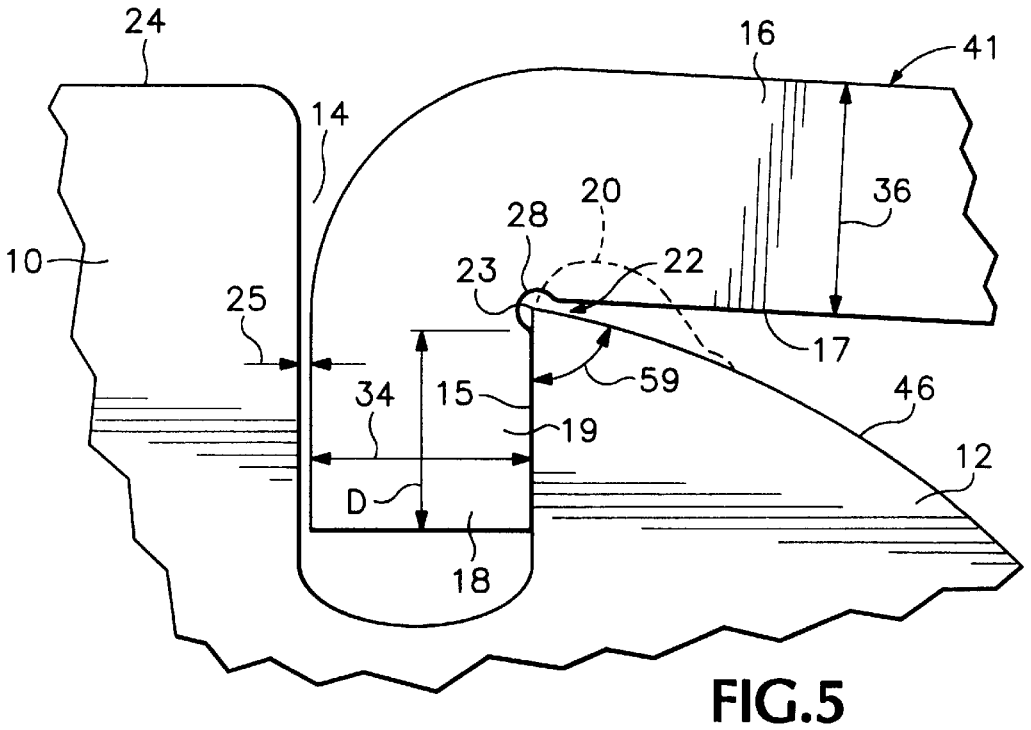
FIG. 5 is a further enlarged view of a detail of the locking mechanism shown in FIG. 4, showing where material has been removed or displaced in the area of a bend defining a flange.

As shown in FIGS. 4 and 5, the present invention answers these problems of the prior art locking mechanism by providing a locking mechanism including a catch 41 having an inside corner 22, formed by the intersection of the spring 16 and the flange 18, which is a sharp right angle with, effectively, a zero radius of curvature. As a result, a force $F_1$ on the back 24 of the blade 10 produces a resultant force $F_2$ of the notch 14 against the flange 18 which is substantially parallel to the spring 16. Note that force $F_2$ has substantially no upward component so long as the flange 18 is not deflected out of parallelism with the interior wall surface 15 of the notch 14. With no upward force to urge the flange 18 out of the notch 14, the blade 10 remains securely locked in place by the catch 41 and is effectively prevented from rotating about the pin 40 until another blade or tool bit having a base similar to the base 12 is rotated about the pin 40 causing a cam lobe similar to the lobe 47 to raise the flange 18 out of the notch 14.

FIG. 5 shows, at an enlarged scale, the spring 16 and flange 18 formed in a preferred way to create effectively a zero radius in the inside corner 22. Material has been removed or displaced from the inside corner 22 defined by the flange 18 and spring 16, resulting in a groove 28 extending across the width of the spring 16 at the position of the bend. The groove 28 thus leaves a curved inside corner surface 29 recessed in the interior angle between extensions of the planes defined by the respective inner surfaces 17 and 19 of the spring 16 and the flange 18, and permits a crisper, more abrupt, bend.

Figure 6:
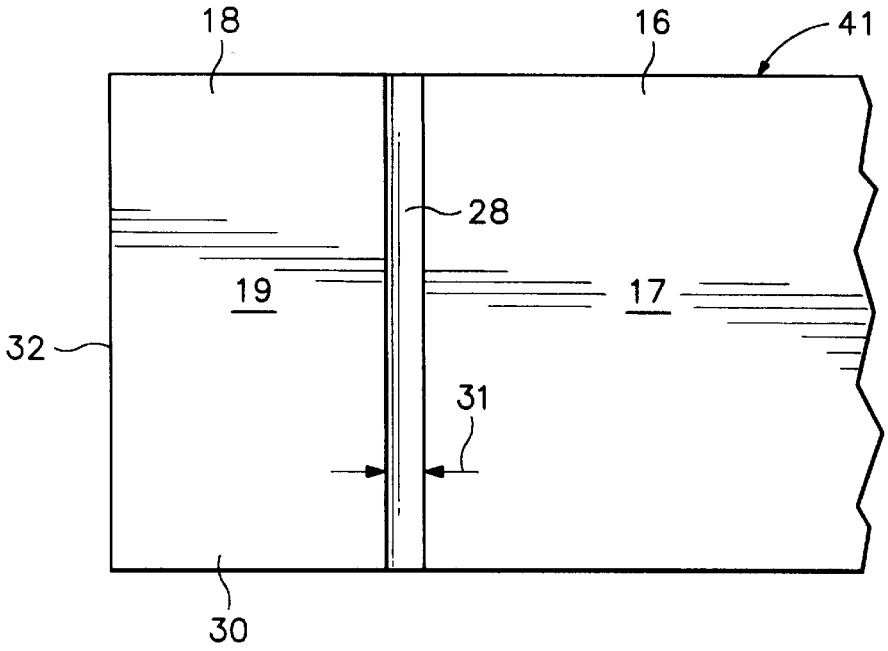
FIG. 6 is a plan view of a portion of the spring catch of the locking mechanism before bending to form the flange.
Figure 7:
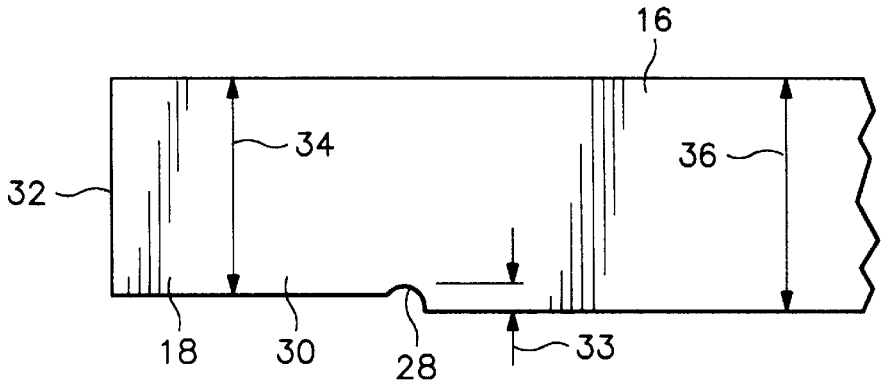
FIG. 7 is a side elevational view of the portion of a spring catch shown in FIG. 6.

FIGS. 6 and 7 show a spring 16 before it has been bent to create a flange 18. The groove 28 has a width 31 which may be, for example, equal to 40% of the thickness 36 of the spring 16, and a depth 33 equal, for example, to 10% of the thickness 36.

In a strip 30 extending transversely across the outer end 32 of the spring 16 material has been removed or displaced to leave a thickness 34 which is no greater than, and usually is less than, the thickness 36 of the remainder of the spring 16. The thickness 34 is thus established within an acceptable tolerance of, for example, ±0.001 inch (0.025 mm), preferably at the same time material is displaced or removed to define the groove 28. A margin of the strip 30 coincides with the intended location of the bend to define the flange 18, as well as with the groove 28. Forming the strip 30 and the groove 28 along the intended location of a bend may be accomplished by a coining step included in a progressive die stamping method of shaping the handles 38 of a tool 11 according to the invention. Alternatively, the strip 30 and the groove 28 could be formed by cutting away some of the material with an appropriate tool or abrasive.

Providing the strip 30 with the proper thickness 34 helps to provide a tight, more reliable locking system and determines the relative sizes of the flange 18 and notch 14. If the flange 18 is too thin with respect to the notch 14 there will be too great a clearance 25 (FIG. 5) and the blade 10 will be able to wiggle. While the width of the notch 14 may be controlled within a tolerance of ±0.001 inch (0.025 mm) by the use of fine blanking dies or milling equipment, the thickness of commercially available sheet steel is usually held only to a loose tolerance, such as ±0.5% of nominal thickness. As a result, the clearance 25 could be more than desirable between the notch 14 and the flange 18, without exceeding tolerances. To provide a good fit of the flange 18 in the notch 14, the thickness 34 of the strip 30 and the resultant flange 18 is preferably reduced to be no greater than the minimum thickness of the sheet metal stock of which the spring 16 is made, as by the step of coining the material in a die to form the strip 30 with the thickness 34 held to a tolerance of ±0.001 inch (0.025 mm).

Figure 8:
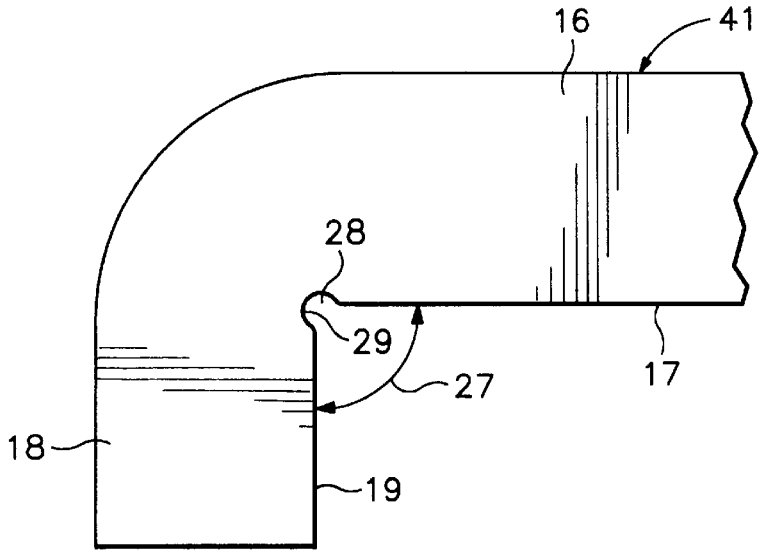
FIG. 8 is a side elevational view of the portion of a spring catch shown in FIG. 7 after it has been bent to form the flange portion.

FIG. 8 shows the spring catch 41 with the flange 18 bent to form an inside corner 22 defining an angle of approximately 90° with the spring 16. The groove 28 makes possible the creation of a sharp right angle with effectively a zero radius in the inside corner 22 between the flange 18 and the spring 16, since the interior surface of the groove 28 is recessed behind the inner surfaces 17 and 19 of the spring 16 and flange 18, respectively. This may actually leave a small gap in the inside corner 22, thus eliminating the availability of any curved surface within the angle 27 defined by extensions of the planes coinciding with the surfaces 17 and 19 to be cammed by the lip 23 of the notch 14.

Referring back to FIG. 2, it can be seen that the spring 16 is defined by the elongate slits 44 located along the juncture of the sidewalls 42 and back 43 of the unitary handle body 38. When the blade 10 is locked in the extended position shown in FIG. 2, with the flange 18 of the spring 16 received in the notch 14 in the blade, it is necessary to force the spring 16 upwardly, away from the blade 10, in order to unlock the blade 10 by removing the flange 18 from the notch 14. As explained above in connection with the prior art mechanism shown in FIG. 3, this is accomplished by partially opening another of the several blades 10 located on the same pin 40 as the extended blade. As the cam surface 46 of the base of the adjacent blade slides along the flange 18, the cam lobe 47 pushes the flange 18 upwardly with respect to the handle 38, deflecting the spring 16 and lifting the flange 18 out of the notch 14 to release the locked blade 10.

From the foregoing explanation it can be understood that a longer flange 18 requires that the spring 16 be deflected upwardly through a greater distance by a cam lobe 47 to unlock a blade 10. Consequently, longer slits 44 must be cut in the handle 38 to create a longer spring 16 capable of greater deflection.

These are undesirable design features which may be avoided by employing a shorter flange 18. However, in order to achieve reliable locking effect the flange 18 must have a sufficiently large area of contact with the inner wall 15 of the notch 14, and any upward component of the force $F_2$ of the lip 23 of the notch 14 against the catch 41 must be too small to overcome the spring 16 and raise the flange 18 out of engagement in the notch 14.

Figure 9:
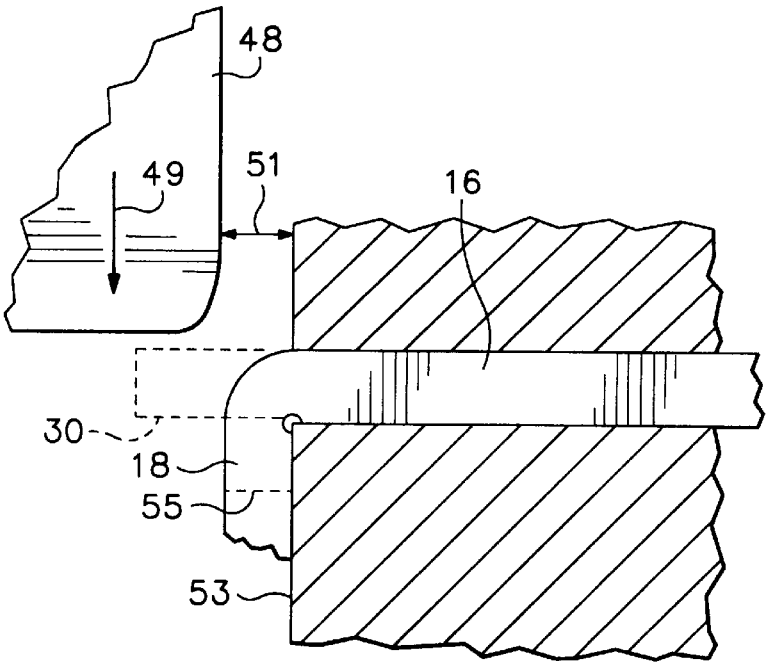
FIG. 9 is a schematic view showing one manner of forming the bend defining the flange of the catch of a locking mechanism such as that shown in FIG. 8.

As shown in FIG. 9, the flange 18 may be formed to the shape shown in FIG. 8 by clamping the spring 116 securely in place while a swaging die 48 is moved downward, as indicated by the arrow 49, to bend the strip 30 downward at the location of the groove 28 and then, if the strip 30 has not been shaped to the desired thickness 34 for the flange 18, to swage the flange 18 to a desired thickness 34, as the die 48 moves past the flange 18 at a predetermined clearance 51 from the face 53 of the clamping device used. Thereafter, the flange 18 may be cut to the appropriate length as defined, for example, by the broken line 55 shown in FIG. 9.

Figure 10:
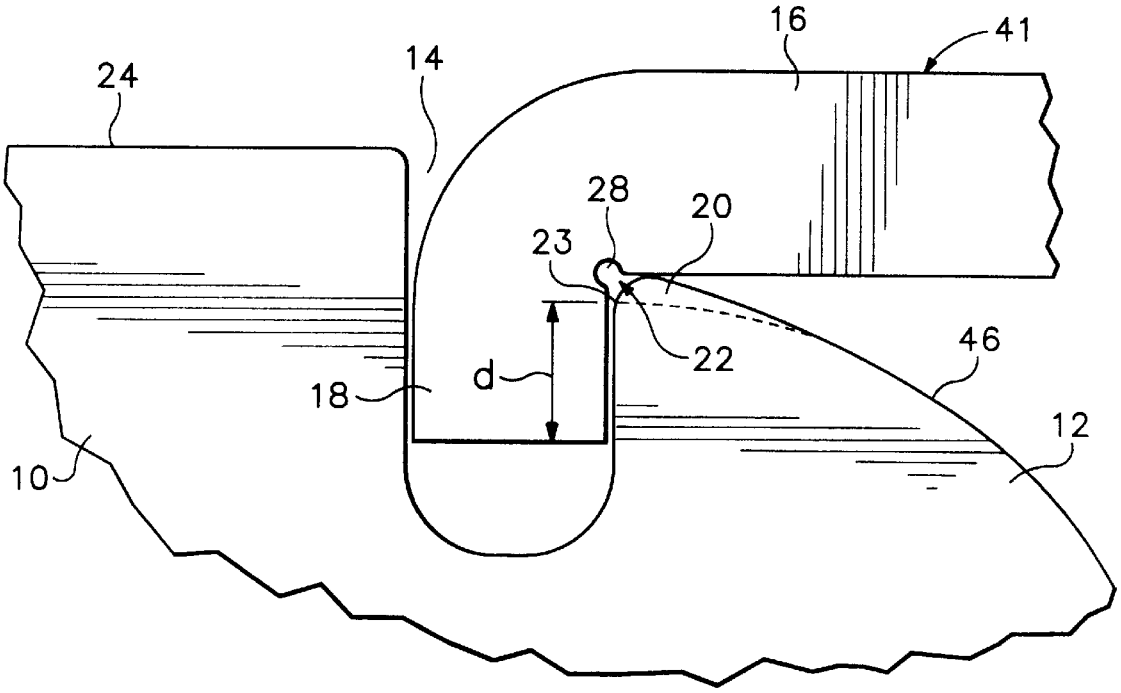
FIG. 10 is a side view of a detail of the locking mechanism shown in FIG. 5 at an intermediate stage of manufacture.

Referring next to FIG. 10, a flange 18 is shown engaged in a notch 14 formed in the base 12 of a blade 10, as by a fine blanking die. According to the common practice in the tool and knife industry, the lips defining the mouth of the notch 214 are relieved with a radius of at least 0.015 inch in material of such thickness. The resultant curved surface of a lip engaging the catch 41 is in the form of a cam lobe 20, and would, if left unchanged, act to raise the catch 41 in response to force tending to fold the blade 18. Because of the cam lobe 10, the flange 18 in FIG. 10 does not contact the wall of the notch 14 at the inside corner 22 between the flange 18 and the spring 16, but at locations a short distance from the inside corner 22 along the flange 18 and the spring 16. The dimension d shown in FIG. 10 is the depth of the available effective locking surface along the flange 18 for contact against the wall of the notch 14.

According to the invention, the material of the cam lobe 20 is removed, as by machining or grinding that part of the base 12 of the blade or tool bit, to create a sharp corner or "bite" which defines the lip 23 of the notch 14 as shown in FIG. 5 forming an angle 59 of about 90° or less between the cam surface 46 and the wall of the notch 14 at the lip 23. This sharp corner or edge of the lip 23 has two beneficial effects. First, it enables a flange 18 to be shorter than required by the prior art flange of FIG. 3 but still provide the same area of effective locking surface. Thus, the depth D of the effective locking surface of the flange 18 in FIG. 5, for example, about 0.040 inch (1.0 mm), is greater than dimension d in FIG. 10, but the flange 18 in FIG. 5 is of identical length, because no flange length is used to bypass a curved surface such as that of the cam lobe 20.

The second beneficial effect of the sharp edge of the lip 23 is a decrease of the possibility that the flange 18 might wiggle out or "cam out" of the notch 14. A camming effect is always possible when curved surfaces press against one another, because a force applied to a curved surface has a component directed perpendicular to a tangent to that surface. Modification of the base 12 by shaping the cam 20 to leave the sharp corner of the lip 23 as shown in FIG. 5 makes it possible for the sharp-edged lip 23 to resist sliding along the spring 16 or flange 18 by biting into their surfaces.

Figure 11:
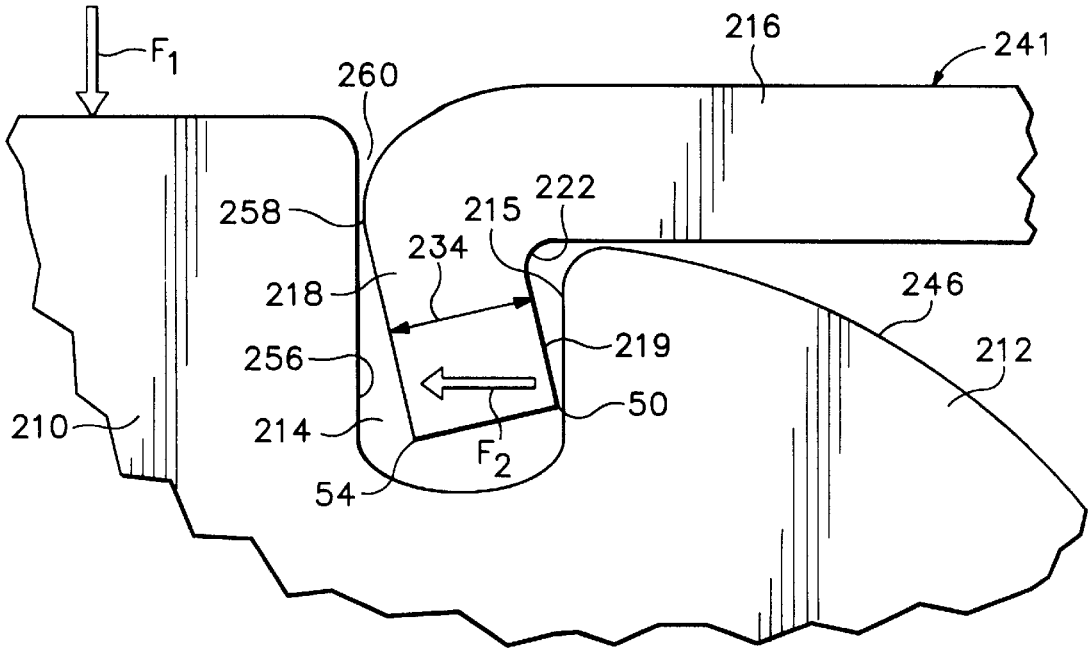
FIG. 11 is a view similar to FIG. 9 showing an alternative locking mechanism according to the present invention in which a spring catch includes an overbent flange.

Turning to FIG. 11, another embodiment of the present invention is depicted. As in the previously described blade locking mechanisms a blade 210 has a notch 214 defined in a base 212, which has a curved cam surface 246. A catch 241 includes a spring 216 and an attached flange 218 which is received in the notch 214. The spring 216 has been overbent, that is, bent to define the flange 218 so that the interior angle 227 at the inside corner 222 between the spring and flange is smaller than 90°, and may be an angle of 80° to 88°. Where a force $F_1$ is applied to the back 224 of the blade 210 a moment is produced about the pin (not shown) on which the blade 210 is mounted. This moment results in a force $F_2$ applied by the wall 215 of the notch 214 against a trailing, or inner, edge 50 of the end of the flange 218. A leading edge 54 of the flange 218, however, is spaced apart from the opposite or outer wall 256 of the notch 214, which an outer face 258 of the flange 218 is in contact with the outer wall 256 near the mouth 260 of the notch 214. The force $F_2$ is directed substantially parallel with the spring 216, and there is little or no upward force tending to urge the flange 218 out of the notch 214. In this embodiment of the invention it is unnecessary for the surfaces of the flange 218 and spring 216 actually to have a zero radius of the surface of the inside corner 222 because the overbending of the flange 218 relative to the spring 216 prevents the curved surface of the inside corner 222 from contacting the lip 223 of the notch 214. At the same time, this construction allows the notch 214 to be wider than the thickness 234 of the flange 218 so that the notch 214 may be less expensive to form.

Figure 12:
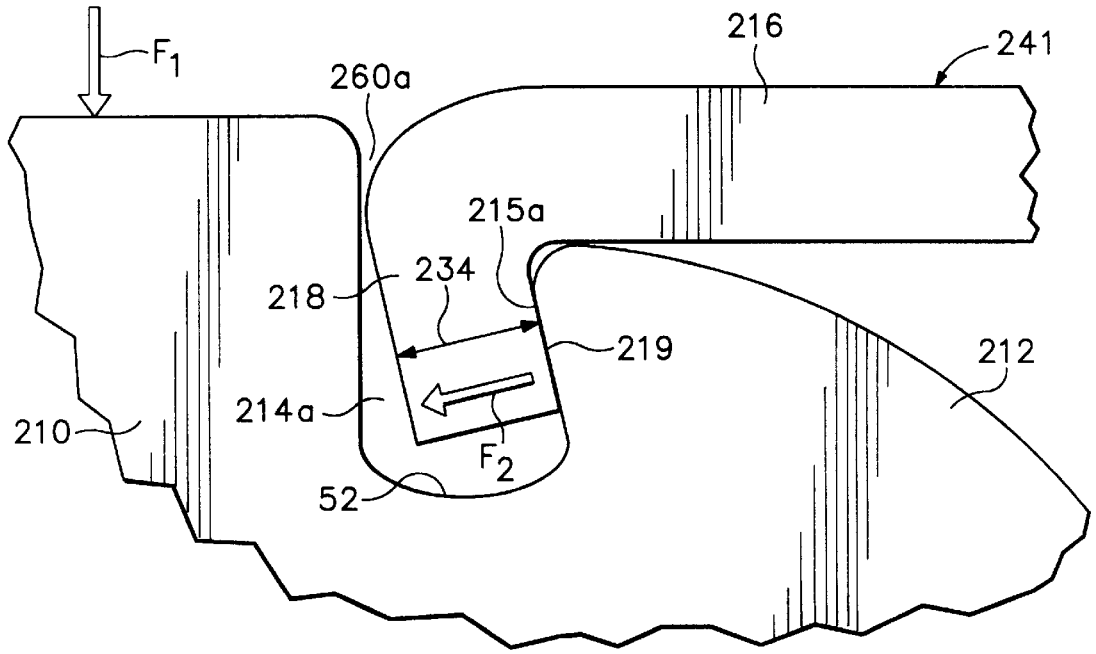
FIG. 12 is a view similar to FIG. 11 showing a further alternative embodiment of the locking mechanism of the invention, in which a spring catch includes the combination of an overbent flange and a wide-bottom, notch.

The embodiment of the invention shown in FIG. 11 may be modified as shown in FIG. 12 by employing the overbent flange 218 in combination with a notch **214*a* whose shape is slightly different from that of the notch 214 in the base 212. As may be seen in FIG. 12, the bottom 52 of the notch 214*a* is wider than its opening, or mouth 260*a*. The surface of the inner wall 215*a* of the notch 214*a*, the wall closer to the spring 216, is slanted forward toward the flange 218 and may preferably be parallel with its inner surface 219. The interaction of the slanted wall 54 with the trailing, or inner, face of the flange results in a force $F_2$ which pulls slightly downward, helping to prevent the flange 218 from inadvertently leaving the notch 214*a* as a result of a force $F_1$ tending to close, or fold, the blade 10. Nevertheless, because the width of the mouth 260*a* of the notch 214*a* is greater than the thickness 234 of the flange 218, the catch 241 can be disengaged as with the previously described embodiments of the locking mechanism of the invention. Another reason for the wider bottom 52 of the notch 214*a* is to provide clearance to allow the flange 218 to drop easily into the notch 214*a***.

Figure 13:
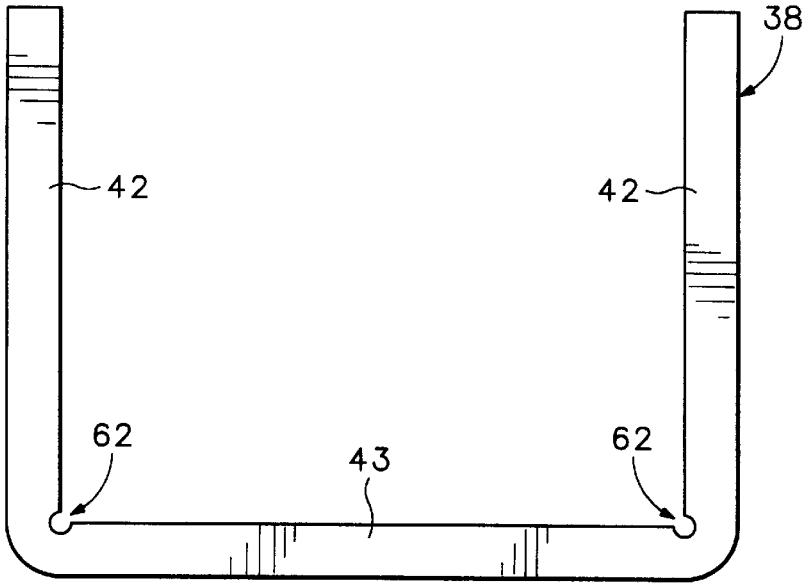
FIG. 13 is a section view of a channel-shaped handle of a tool taken along line 13—13 of FIG. 2 at an enlarged scale.
Figure 14:
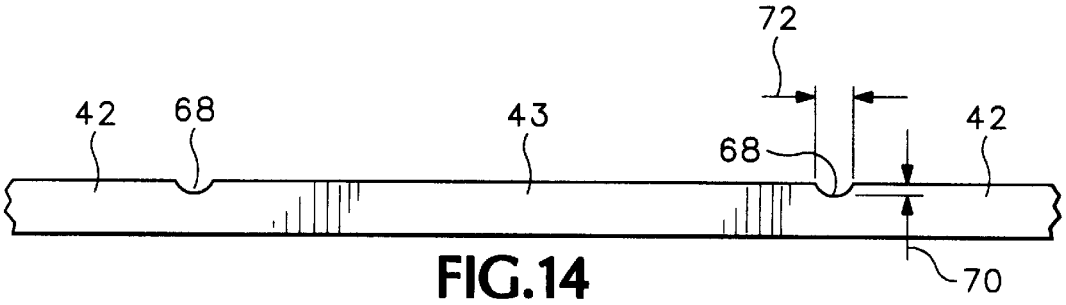
FIG. 14 is a section view of the material of the channel shown in FIG. 13, prior to being bent.
Figure 15:
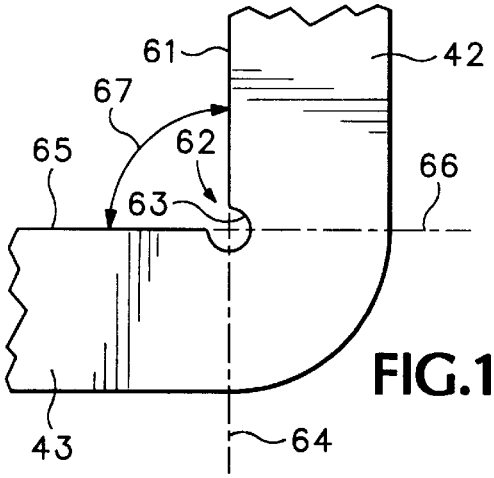
FIG. 15 is a further enlarged view of a corner bend of the channel shown in FIG. 13.

Referring finally to FIGS. 13, 14 and 15, each channel-shaped handle member 38 preferably is formed of the piece of sheet metal stock of which the catch 41 is a part and includes longitudinal folds defining corners 62 between the side walls 42 and the base or back 43 of the channel. Each of the corners 62 has effectively a zero radius inner surface since the inner surface 63 is actually recessed, as shown in FIG. 15, so that planes 64 and 66, which coincide with and are extensions, respectively, of the inner surfaces 61 and 65, respectively, of the sidewalls 42 and the base 43 of the channel, intersect to include no material within the angle 67 defined by their intersection.

The recessed surfaces 63 are provided by forming a pair of grooves 68, each having a depth 70 and a width 72, as by use of an appropriate die as a part of the progressive die stamping operation used in manufacturing the handle member 38. While grooves having various widths and depths may provide satisfactory results, it has been found by experimentation that a depth 70 equal to about 10% of the thickness of the sheet metal stock and a width 72 equal to about 40% of the thickness of the sheet metal stock satisfactorily provides the desired recessed position of the surface 63, as shown in FIG. 15, and provides, effectively, a zero radius of curvature within the corners 62 of the channel shape when the side walls 42 are bent along the grooves 68. The zero radius corners 62 of the channel provide room for the kick 74 of a blade 10 (FIG. 1) adjacent either of the sidewalls 42 to rest upon the inner surface of the back 43 or of the spring 16, without having to be beveled to obtain clearance.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a blade locking mechanism for a tool of the type having a handle, a plurality of folding blades each moveable independently about a common pin and each having a respective base defining a respective notch, and a spring catch associated with said handle, said spring catch including a spring carrying a flange which is received selectively into the respective notch of one of said blades to lock said blade in an extended position, said flange being integral with said spring and formed therefrom, the improvement comprising said spring and said flange forming an inside corner of approximately 90° having effectively a zero radius of curvature and each of said plurality of blades including, on said respective base thereof, a respective cam that engages said flange, removing said flange from said notch of any other one of said blades in which said flange may have been received, when any one of said blades including such a cam is moved to a respective predetermined position, wherein a portion of the material of said spring has been displaced in the area of said inside corner, said inside corner including a recessed surface and said spring and said flange having substantially planar surfaces abutting said recessed surface.

2. In a blade locking mechanism for a tool of the type having a handle, a plurality of folding blades each moveable independently about a common pin and each having a respective base defining a respective notch, and a spring catch associated with said handle, said spring catch including a spring carrying a flange which is received selectively into the respective notch of one of said blades to lock said blade in an extended position, said flange being integral with said spring and formed therefrom, the improvement comprising said spring and said flange forming an inside corner of approximately 90° having effectively a zero radius of curvature, a groove defined between said flange and said spring in the area of said inside corner, and each of said plurality of blades including, on said respective base thereof, a respective cam that engages said flange, removing said flange from said notch of any other one of said blades in which said flange may have been received, when any one of said blades including such a cam is moved to a respective predetermined position.

3. In a blade locking mechanism for a tool of the type having a handle, a plurality of folding blades each moveable independently about a common pin and each having a respective base defining a respective notch, and a spring catch associated with said handle, said spring catch including a spring having an integral flange which is received selectively into the respective notch of one of said blades to lock said blade in an extended position, the improvement comprising said spring and said flange forming an inside corner wherein said flange forms an angle of less than 90° with said spring, said corner having effectively a zero radius of curvature and each of said plurality of blades including, on said respective base thereof, a respective cam that engages said flange, removing said flange from said notch of any other one of said blades in which said flange may have been received, when any one of said blades including such a cam is moved to a respective predetermined position.

4. In a blade locking mechanism for a tool of the type having a handle, a plurality of folding blades each moveable independently about a common pin and each having a respective base defining a respective notch, and a spring catch associated with said handle, said spring catch including a spring having an integral flange which is received selectively into the respective notch of one of said blades to lock said blade in an extended position, the improvement comprising said notch having an opening and a bottom, the bottom of said notch being wider than said opening and each of said plurality of blades including, on said respective base thereof, a respective cam that engages said flange, removing said flange from said notch of any other one of said blades in which said flange may have been received, when any one of said blades including such a cam is moved to a respective predetermined position.

5. In a blade locking mechanism for a tool of the type having a handle, a folding blade having a base defining a notch having a pair of opposite walls, and a spring catch associated with said handle and including a spring carrying a flange which is received selectively into said notch to lock said blade in an extended position, the improvement comprising:

(a) said flange having a thickness and said notch having a width which is greater than said thickness of said flange; and (b) said flange adjoining said spring in an inside corner forming an angle of less than 90° to said spring and being located in said notch with said flange extending at an angle with respect to said notch so as to fit snugly in said notch.

6. The blade locking mechanism of claim 5 wherein said spring has an inner face proximate said base of said blade and an opposite outer face, and said flange having a trailing edge in substantial contact with a wall of said notch when said flange is positioned in said notch.

7. The blade locking mechanism of claim 6 wherein said flange has a leading edge which is substantially free of contact with either wall of said notch.

8. The blade locking mechanism of claim 6 wherein said notch in said base of said blade includes an outer wall proximate said blade and an inner wall further from said-blade, said trailing edge of said flange being in substantial contact said inner wall of said notch.

9. The blade locking mechanism of 6 wherein said notch has an opening and a bottom, the bottom of said notch being wider than said opening.

* * * * *